US010413035B2

(12) United States Patent
Limongi et al.

(10) Patent No.: US 10,413,035 B2
(45) Date of Patent: Sep. 17, 2019

(54) CASING FOR A COSMETIC ARTICLE

(71) Applicant: ALBEA SERVICES, Gennevilliers (FR)

(72) Inventors: Michel Limongi, Clichy (FR); Vincent Lequeux, Paris (FR); Nicolas Rondeau, Villeneuve la Garenne (FR)

(73) Assignee: ALBEA SERVICES, Gennevilliers (FR)

( * ) Notice: Subject to any disclaimer, the term of this patent is extended or adjusted under 35 U.S.C. 154(b) by 230 days.

(21) Appl. No.: 15/009,971

(22) Filed: Jan. 29, 2016

(65) Prior Publication Data

US 2016/0143411 A1 May 26, 2016

Related U.S. Application Data

(63) Continuation of application No. 13/976,079, filed as application No. PCT/EP2011/072177 on Dec. 8, 2011, now Pat. No. 9,289,047.

(30) Foreign Application Priority Data

Dec. 28, 2010 (EP) ..... 10306532

(51) Int. Cl.
*A45D 33/00* (2006.01)
*B65D 5/52* (2006.01)
*A45D 33/20* (2006.01)

(52) U.S. Cl.
CPC ..... *A45D 33/008* (2013.01); *A45D 33/00* (2013.01); *A45D 33/20* (2013.01); *B65D 5/5213* (2013.01); *A45D 2200/052* (2013.01)

(58) Field of Classification Search
CPC ..... A45D 2040/225; A45D 2200/052; A45D 33/00; A45D 33/008; A45D 33/20; A45D 40/24; B65D 5/5213; B65F 200/1669
(Continued)

(56) References Cited

U.S. PATENT DOCUMENTS 371,182 A 10/1887 Evans
1,453,563 A 5/1923 Albert
(Continued)

FOREIGN PATENT DOCUMENTS

FR 2919158 A1 1/2009
GB 2143804 2/1985
WO 2006111232 10/2006

OTHER PUBLICATIONS

PCT/EP2011/072177, International Search Report, dated May 3, 2012.

*Primary Examiner* — Tatiana L Nobrega
*Assistant Examiner* — Jennifer F Gill
(74) *Attorney, Agent, or Firm* — Banner & Witcoff, Ltd.

(57) ABSTRACT

A casing for a cosmetic article has a base having an inner surface which accommodates a mirror. A lid is rotatably and directly mounted to the base, the lid being rotatable, relative to the base, between a closed position and an opened position. An intermediate tray is located between the base and the lid for accommodating the cosmetic article and covering the whole base, the intermediate tray being slidably mounted to the base so as to be movable relative to the base between a retracted position, in which the intermediate tray substantially covers the inner surface of the base, and an extended position, in which the intermediate tray exposes the inner surface of the base. The intermediate tray being further rotatably or slidably mounted to the lid so as to be movable relative to the lid. Rotation of the lid from the closed position to the open position causes the tray to slide from the retracted position to the extended position.

16 Claims, 5 Drawing Sheets

(58) Field of Classification Search
USPC ..... 132/287, 293–295; 206/754; 220/521
See application file for complete search history.

(56) References Cited

U.S. PATENT DOCUMENTS

| | | | | | |
|---|---|---|---|---|---|
| 1,541,451 | A | * | 6/1925 | Wallace | A45D 33/006 132/296 |
| 1,549,276 | A | | 8/1925 | Loesser | |
| 1,558,471 | A | | 10/1925 | Goertz | |
| 1,558,492 | A | | 10/1925 | Morrison | |
| 1,661,215 | A | * | 3/1928 | Causey | A24F 19/0064 132/301 |
| 1,663,244 | A | * | 3/1928 | Dewey | A45C 5/005 132/315 |
| 2,219,597 | A | * | 10/1940 | Lutz | A45D 29/20 132/73 |
| 2,461,421 | A | | 2/1949 | Jacobus | |
| 2,775,342 | A | | 12/1956 | Smith | |
| 3,140,777 | A | * | 7/1964 | Gordan | A45C 11/24 206/315.1 |
| 3,586,010 | A | * | 6/1971 | Landen | A45D 40/22 132/287 |
| D280,450 | S | * | 9/1985 | Schefer | D28/78 |
| 4,580,586 | A | * | 4/1986 | Kitoh | A45D 40/22 132/315 |
| 5,337,890 | A | * | 8/1994 | Lai | A45C 11/008 132/296 |
| 5,353,947 | A | * | 10/1994 | Zinnbauer | A45D 40/22 206/581 |
| 5,586,653 | A | * | 12/1996 | Taveroff | A45D 40/24 132/295 |
| D625,930 | S | | 10/2010 | Merica | |
| 2008/0142031 | A1 | * | 6/2008 | Francis | A45D 33/008 132/200 |
| 2008/0142532 | A1 | | 6/2008 | Corbellini et al. | |
| 2008/0257376 | A1 | | 10/2008 | Pires et al. | |
| 2009/0032052 | A1 | * | 2/2009 | Lee | A45D 33/006 132/296 |

* cited by examiner

CASING FOR A COSMETIC ARTICLE

CROSS REFERENCE TO RELATED APPLICATIONS

This application is a continuation of U.S. application Ser. No. 13/976,079, filed Jun. 26, 2013, which is a National Stage application of co-pending PCT application PCT/EP2011/072177 filed Dec. 8, 2011, which claims benefit of European application number 10306532.2, filed Dec. 28, 2010. These applications are herein incorporated by reference in their entireties.

FIELD OF THE INVENTION

The invention relates to a casing for a cosmetic article.

BACKGROUND OF THE INVENTION

Casings containing cosmetic articles are known, and typically comprise a base having one or more recesses for accommodating cosmetic articles, such as cosmetic powder pans and associated cosmetic applicators, and a cover which is hinged to the base for closing or opening the casing.

In some casings, a mirror may be fixed to an inner surface of the cover, so that when the user opens the casing, he or she can simultaneously access the cosmetic article and make the mirror appear in a single gesture, the mirror facilitating the application of the relevant cosmetic product.

In other casings, the cover comprises a window through which the cosmetic article can be viewed when the cover is in the closed position. Such a window allows the appearance of the cosmetic article housed within the casing to be displayed, without the need to open the casing. Such a presentation is particularly advantageous when the casings are displayed in retail stores. As the cosmetic articles are visible through the cover, it is not necessary to provide separate descriptions of the articles, such as photographs, colour charts, or separate testing samples. However, due to the presence of a window in the cover, it is generally not possible to include a mirror in the cover. To overcome this, casings have been known to provide windows in their base but this is far from convenient, as it also means that the pan in which the cosmetic product is prepared has to be transparent. This limits the pan to plastic material, and still does not allow the consumer to see the cosmetic product when it is displayed on the shelf.

OBJECT OF THE INVENTION

An aim of the invention is therefore to provide a casing for a cosmetic article, which not only can accommodate a mirror, to facilitate the application of the cosmetic product, but which simultaneously can include a window on the top surface, ie the cover, to enable a visual inspection of the cosmetic articles when the casing is closed.

SUMMARY OF THE INVENTION

According to the invention there is provided a casing for a cosmetic article, the casing comprising:

- a base having an inner surface which accommodates a mirror;
- a lid rotatably mounted to the base, the lid being rotatable, relative to the base, between a closed position and an opened position; and

- an intermediate tray located between the base and the lid for accommodating the cosmetic article, the intermediate tray being slidably mounted to the base so as to be movable relative to the base between a retracted position, in which the intermediate tray substantially covers the inner surface of the base, and an extended position, in which the intermediate tray exposes the mirror, wherein rotation of the lid from the closed position to the open position causes the tray to slide from the retracted position to the extended position.

In an embodiment, when the lid is in the opened position and the intermediate tray is in the extended position the mirror is exposed.

In an embodiment, the lid comprises an inspection window, so that when the lid is in the closed position the cosmetic article can be visually inspected through the inspection window.

In an embodiment, the intermediate tray is mounted to the lid so that when the lid is rotated from the closed position to the opened position, the intermediate tray automatically slides from the retracted position to the extended position so as to expose the mirror.

In an embodiment, the base comprises a first guide channel and the intermediate tray comprises a first guide pin that can slide along the first guide channel of the base as the intermediate tray slides between the retracted and extended positions.

In an embodiment, the first guide channel allows the simultaneous rotation and translation of the first guide pin within the first guide channel.

In an embodiment, the lid is rotatably mounted to the base about a first axis (axis of rotation), and the intermediate tray is slidably mounted to the base according to a second axis (axis of sliding), the second axis being perpendicular to the first axis.

In a first embodiment, the intermediate tray is rotatably mounted to the lid, with the rotatable mounting between the lid and the base and the rotatable mounting between intermediate tray and the lid defining a hinging arrangement to cause the automatic sliding of the intermediate tray relative to the base when the lid is moved from the closed position to the opened position.

In a second embodiment, the intermediate tray is slidably mounted to the lid so as to be slidably movable, relative to the lid, when the lid is rotated from the closed position to the opened position.

In an embodiment, the sliding movement of the intermediate tray relative to the base occurs simultaneously with the sliding movement of the intermediate tray relative to the lid.

In an embodiment, the lid comprises a second guide channel and the intermediate tray comprises a second guide pin that can slide along the second guide channel of the lid as the lid is rotated from the closed position to the opened position.

In an embodiment, the intermediate tray is rotatably mounted to the lid, with the second guide channel allowing the simultaneous rotation and translation of the second guide pin within the second guide channel.

In an embodiment, the casing includes a support arm having a first end which is hinged to the base and a second end which is hinged to the intermediate tray, so as to guide the sliding movement of the intermediate part relative to the base and the lid.

In an embodiment, the base defines a recess for snugly accommodating the intermediate tray when the lid is in the closed position.

DESCRIPTION OF PREFERRED EMBODIMENTS

Figure 1:
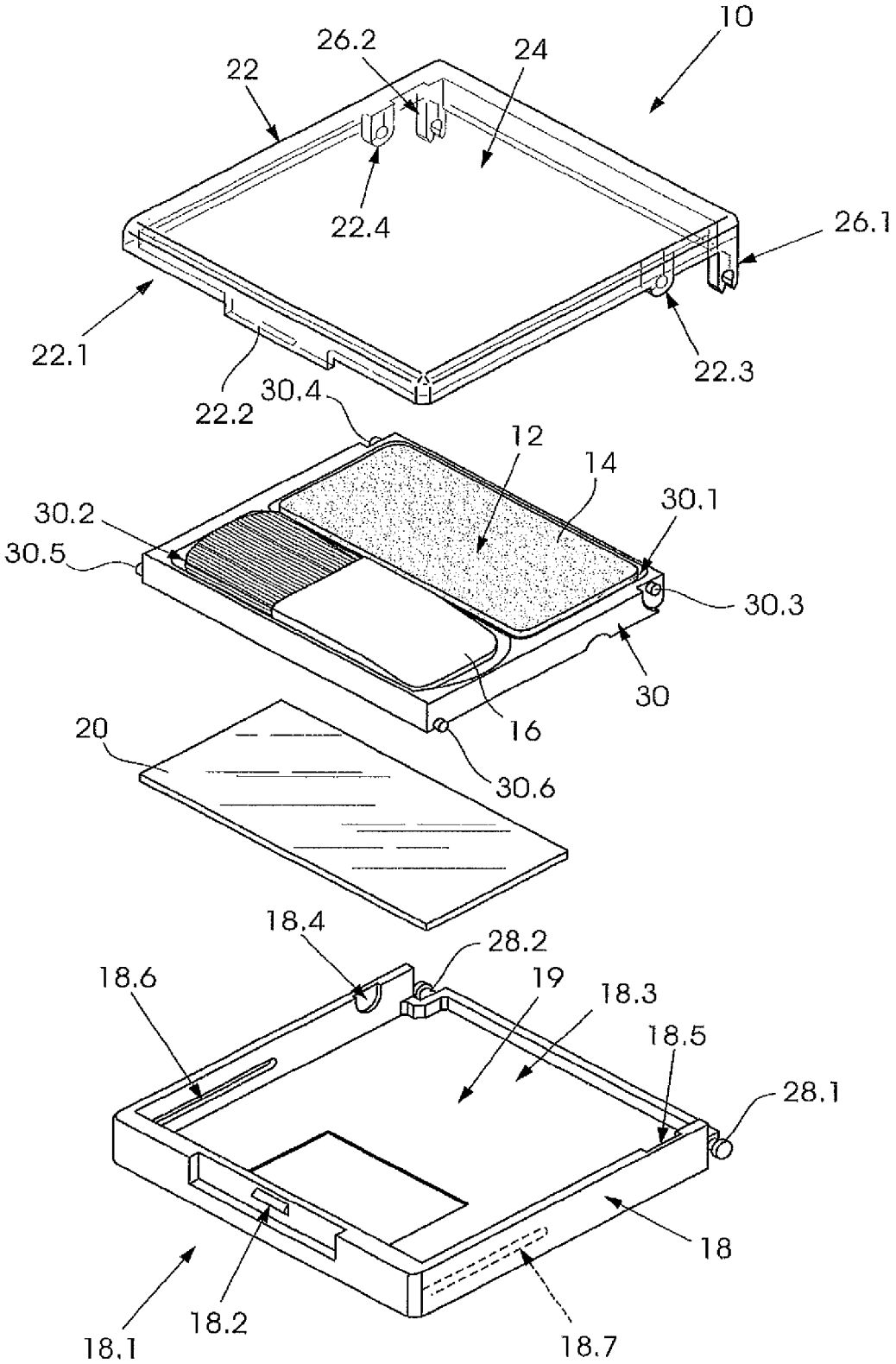
FIG. 1 shows an exploded perspective view of a casing for a cosmetic article according to a first embodiment of the present invention.

Referring first to FIGS. 1 to 6, a casing 10 for a cosmetic article 12 is provided. As indicated above, the cosmetic article 12 may comprise a cosmetic powder pan 14 and an associated cosmetic applicator 16. The casing 10 comprises a base 18 having an inner surface 19 that typically accommodates a mirror 20, as well as a lid 22 to cover the base 18. The lid 22 typically comprises a translucent or transparent inspection window 24, but the lid 22 may also be opaque. In the illustrated embodiments, the inspection window 24 occupies the entire area of the lid 22, but clearly the inspection window 24 may be provided in a dedicated area within the lid 22, so as to, for example, only display the cosmetic powder pan 14.

Figure 2:
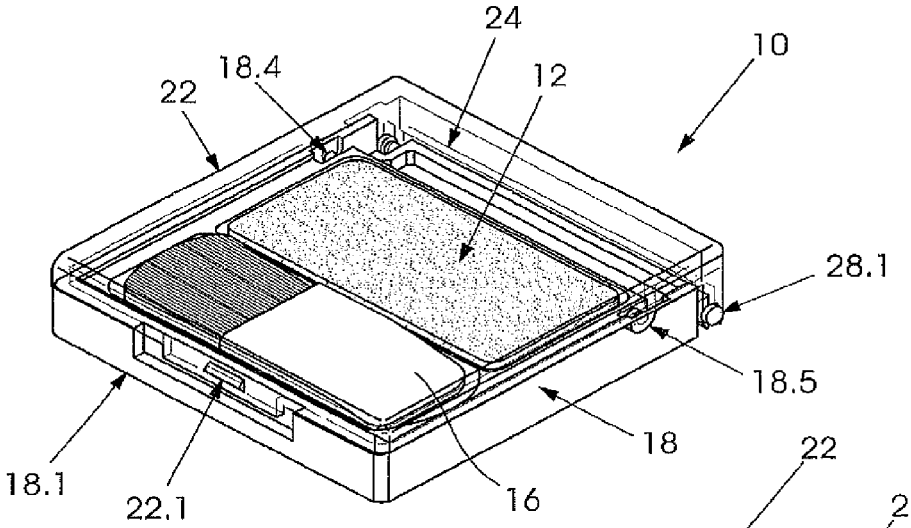
FIG. 2 shows a perspective view of the casing of FIG. 1 in a fully closed position.
Figure 3:
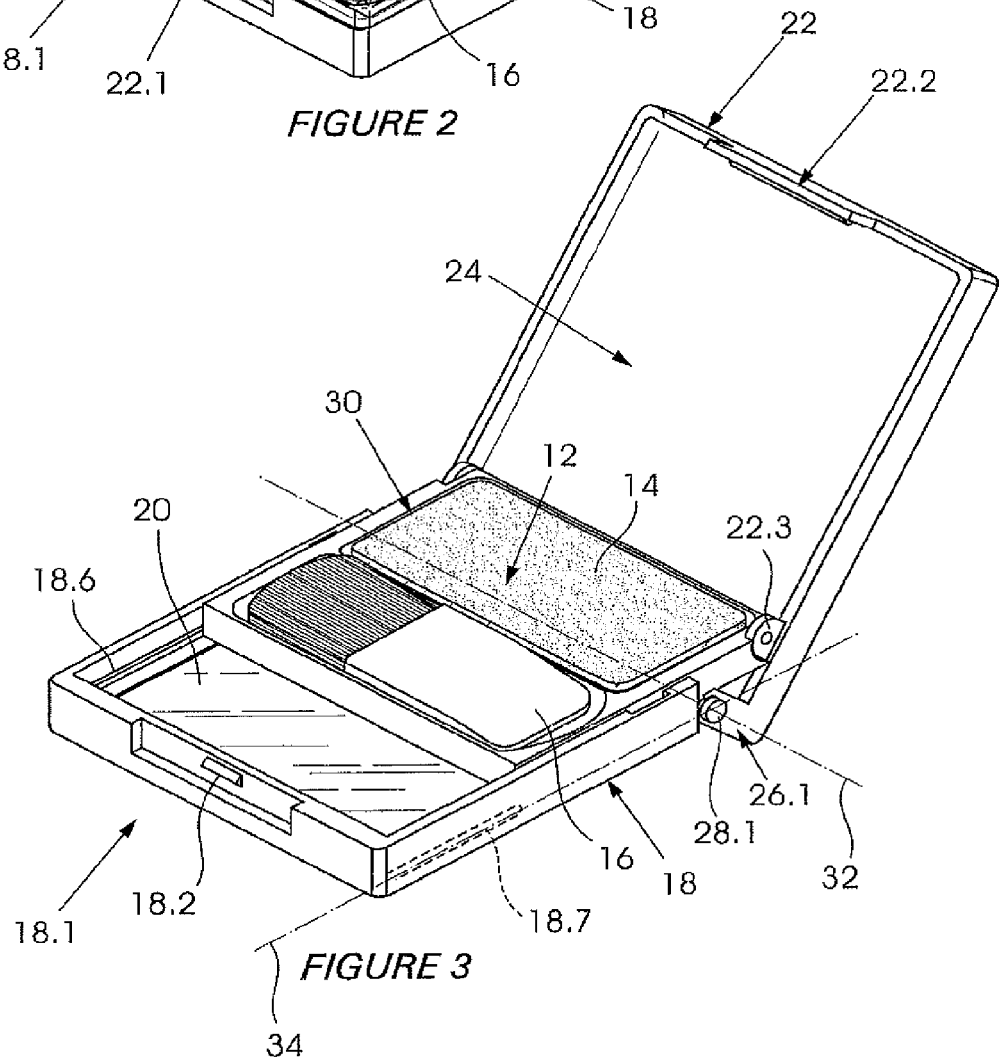
FIG. 3 shows a perspective view of the casing of FIG. 1 in a fully opened position.
Figure 4:
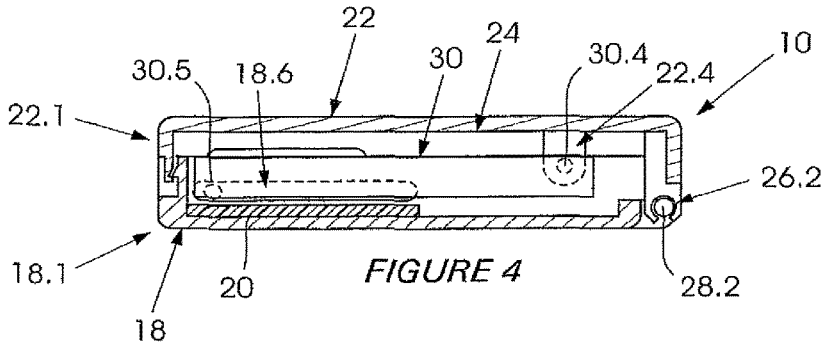
FIGS. 4 to 6 show cross-sectional side views of the casing of FIGS. 1 to 3, as the casing moves from a fully closed position (FIG. 4), to a semi-opened position (FIG. 5) and then finally to a fully opened position (FIG. 6)
Figure 5:
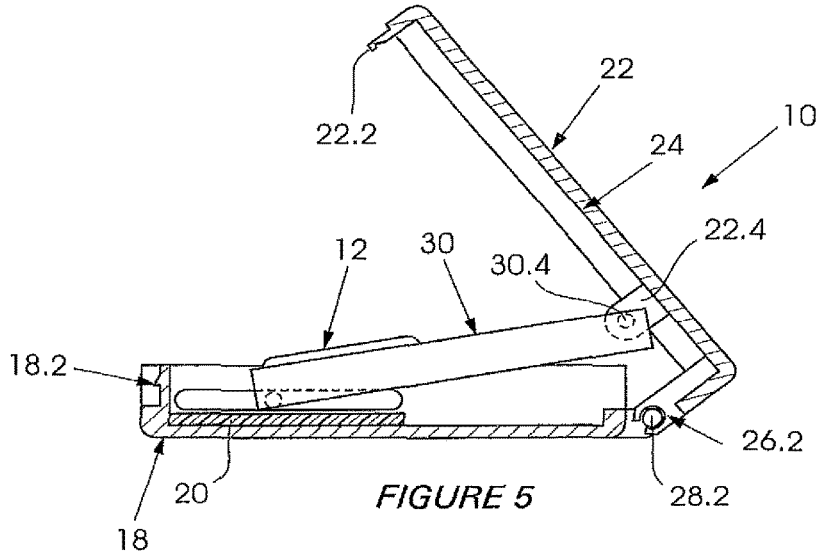
Figure 6:
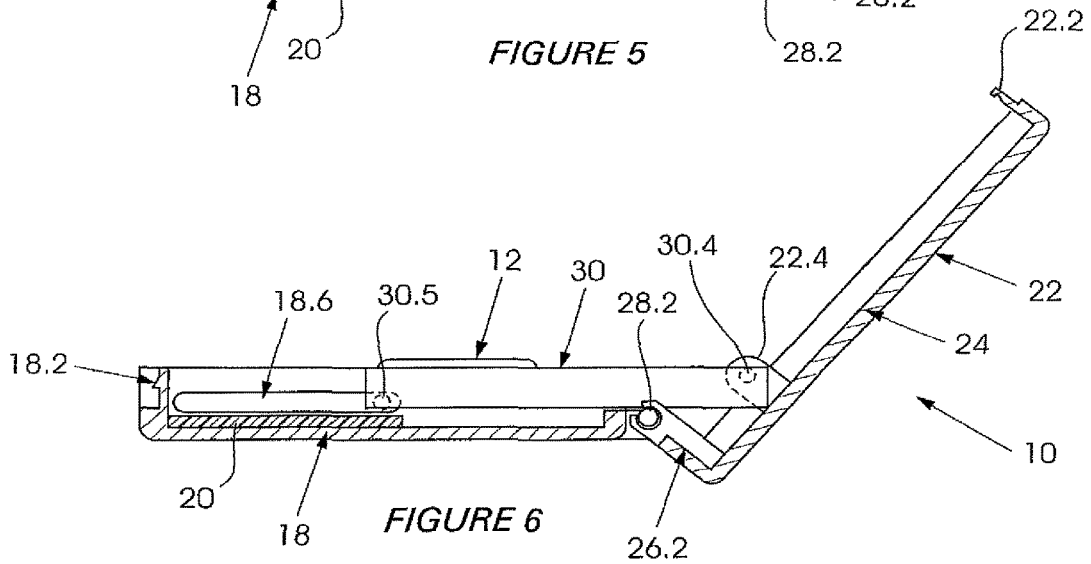

The lid 22 is movable, relative to the base 18, between a closed position, as shown in FIGS. 2 and 4, and an opened position, as shown in FIGS. 3 and 6 (and any intermediate position, such as the semi-opened position shown in FIG. 5). In the illustrated embodiment, the lid 22 is rotatably mounted to the base 18, with the lid 22 comprising a first pair of ears or lugs 26.1, 26.2 that are rotatably fitted to a corresponding pair of pins 28.1, 28.2 extending from the base 18. This arrangement constitutes hinge means allowing rotation of the lid 22 relative to base 18, in a well known manner.

The free edges 22.1, 18.1 of the lid 22 and base 18, respectively, may be fitted with complementary snap-fit formations 22.2, 18.2, respectively, to enable the base 18 and the lid 22 to be securely fastened to each other when the lid 22 is in a closed position.

The casing 10 further comprises an intermediate tray 30 located between the base 18 and the lid 22, with the base 18 defining a recess 18.3 for snugly accommodating the intermediate tray 30 when the lid 22 is in the closed position. The intermediate tray 30 in turn accommodates or houses the cosmetic article 12 either loosely or within dedicated recesses 30.1, 30.2 for the cosmetic powder pan 14 and the applicator 16, respectively.

The intermediate tray 30 is slidably mounted to the base 18 so as to be movable relative to the base 18 from a retracted position, as shown in FIGS. 2 and 4, in which the intermediate tray 30 substantially covers the base 18, to a semi-extended position, as shown in FIG. 5, and a fully extended position, in which the intermediate tray 30 exposes the inner surface 19 of the base 18 and thus, typically, the underlying mirror 20, as shown in FIGS. 3 and 6.

As best shown in FIG. 3, the lid 22 is rotatably mounted to the base 18 about a first axis of rotation 32, and the intermediate tray 30 is slidably mounted to the base 18 according to a second axis of sliding 34, the second axis 34 being perpendicular to the first axis of rotation 32.

In the retracted position, as shown in FIGS. 2 and 4, the mirror 20 is sandwiched between the base 18 and the intermediate tray 30.

Thus, in use, but as will be explained in more detail further below, when the lid 22 is in the closed position the cosmetic article 12 can be visually inspected through the inspection window 24, and when the lid 22 is in the opened position and the intermediate tray 30 is in the extended position the mirror 20 is exposed.

In the illustrated embodiment, the intermediate tray 30 is mounted to the lid 22 so that when the lid 22 is moved from the closed position to the opened position, the intermediate tray 30 is pulled by the lid 22 and automatically slides from the retracted position to the extended position so as to expose the inner surface 19, and thus the mirror 20. In particular, the intermediate tray 30 is rotatably mounted to the lid 22, with the lid comprising a second pair of ears or lugs 22.3, 22.4 that are rotatably fitted to a corresponding pair of pins 30.3, 30.4, respectively, extending from the side walls of the intermediate tray 30. This allows rotation of the tray 30 relative to the lid 22 while the lid 22 is moved, with the base 18 having slots 18.4, 18.5 on the inner parts of its side wall to accommodate the second pair of ears or lugs 22.3, 22.4 of the lid 22, as best shown in FIG. 2.

The rotatable mounting between the lid 22 and the base 18 and the rotatable mounting between intermediate tray 30 and the lid 22 defines a hinging arrangement to cause the automatic sliding of the intermediate tray 30 relative to the base 18 when the lid 22 is moved from the closed position to the opened position.

In an embodiment, the base 18 comprises a pair of opposed first guide channels 18.6, 18.7 and the intermediate tray 30 comprises a corresponding pair of first guide pins 30.5, 30.6 extending from the side walls of the tray 30. The first guide channels 18.6, 18.7 are rectilinear and extend along a direction which is perpendicular to the axis of rotation of the lid 22 relative to the base 18. The length of the first guide channels 18.6, 18.7 is designed so as to limit the length of travel of the tray 30 between its retracted and extended positions. Thus, when the first guide pins 30.5, 30.6 abut against the ends of the first guide channels 18.6, 18.7, this defines the fully opened position shown in FIGS. 3 and 6. In one version, the first guide channels 18.6, 18.7 extend up to approximately midway of the length of the base 18, with this distance corresponding substantially with the width of the underlying mirror 20.

The first guide pins 30.5, 30.6 are snugly accommodated within the first guide channels 18.6, 18.7 so that the pins 30.5, 30.6, and thus the tray 30, can slide along the first guide channels 18.6, 18.7 of the base 18 as the intermediate tray 30 slides between the retracted and extended positions. In addition, since the lid 22 is rotatably mounted to the base 18, the first guide channels 18.6, 18.7 allow the simultaneous rotation and translation of the first guide pins 30.5, 30.6 within the first guide channels 18.6, 18.7.

Turning now to FIGS. 7 to 11, a second embodiment of a casing 50 for a cosmetic article 52 is provided, the cosmetic article 52 again typically comprising a cosmetic powder pan 54 and an associated cosmetic applicator 56.

The casing 50 comprises a base 58 having an inner surface 59 that typically accommodates a mirror 60, as well as a lid 62 to cover the base 58. Significantly, the mirror 60 substantially covers the entire inner surface 59 of the base 58, and is thus significantly larger than the mirror 20 used in the first embodiment shown in FIGS. 1 to 6. The lid 62 typically comprises a translucent or transparent inspection window 64, which can either occupy the entire area of the lid 62, as shown, or take up a smaller area of the lid 62 so as to, for example, only display the cosmetic powder pan 54. In one version, however, the lid 62 may be opaque.

Figure 7:
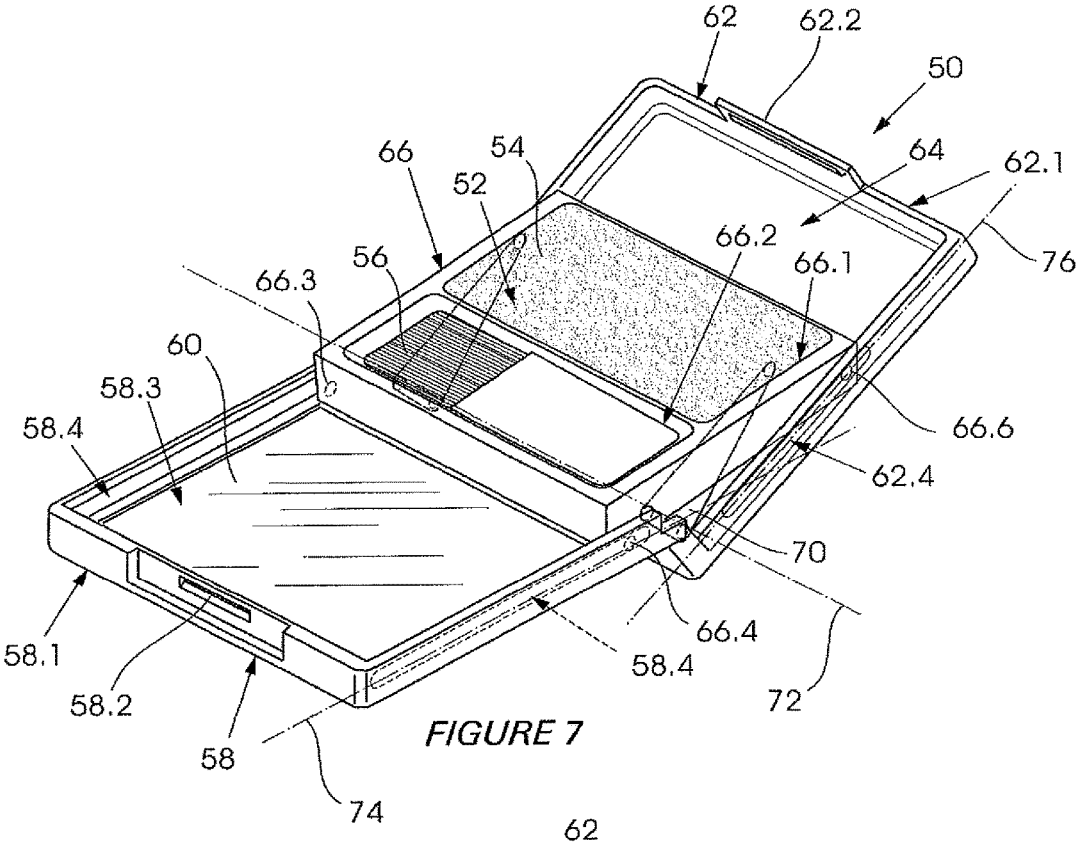
FIG. 7 shows a perspective view of a casing for a cosmetic article according to a second embodiment of the present invention, the casing being shown in a fully opened position.
Figure 8:
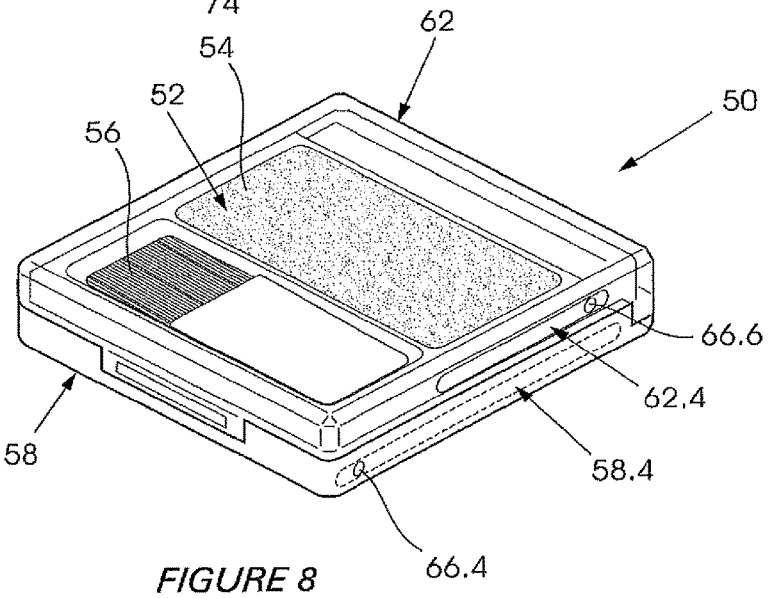
FIG. 8 shows a perspective view of the casing of FIG. 7 in a fully closed position.
Figure 9:
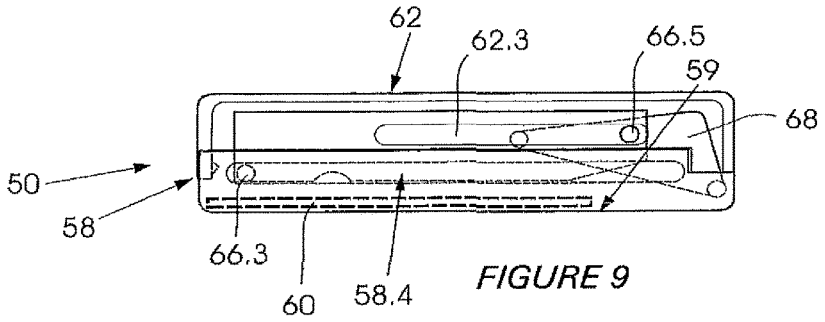
FIGS. 9 to 11 show cross-sectional side views of the casing of FIGS. 7 and 8, as the casing moves from a fully closed position (FIG. 9), to a semi-opened position (FIG. 10) and then finally to a fully opened position (FIG. 11).
Figure 10:
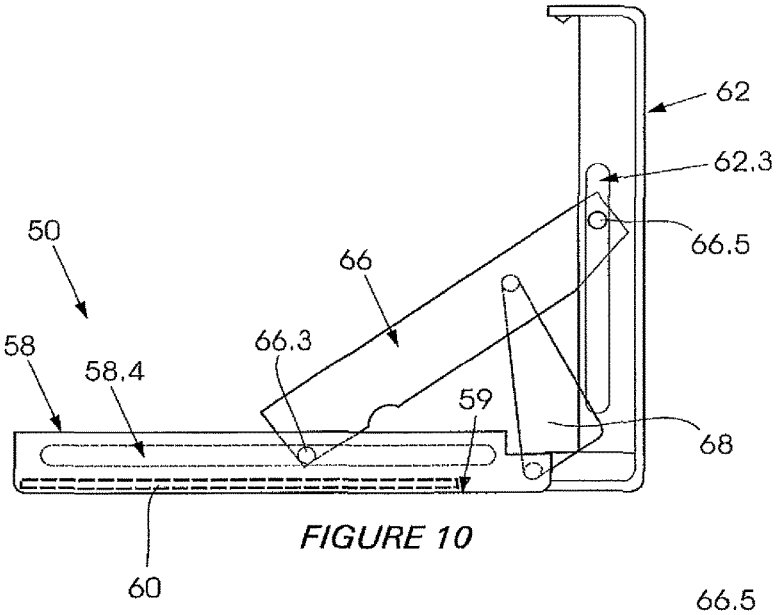
Figure 11:
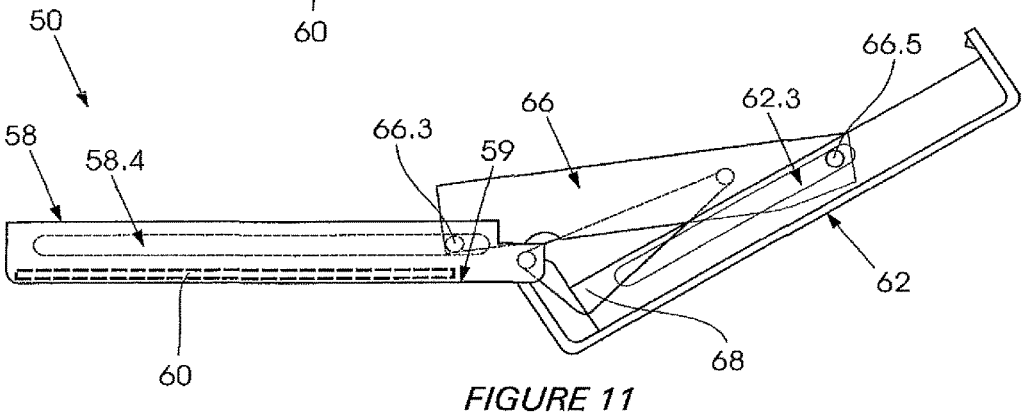

The lid 62 is movable, relative to the base 58, between a closed position, as shown in FIGS. 8 and 9, and an opened position, as shown in FIGS. 7 and 11 (and any intermediate position, such as the semi-opened position shown in FIG. 10). In the illustrated embodiment, the lid 62 is rotatably mounted to the base 58 in any one of a number of well known ways, such as with the use of ears or lugs on the lid that are rotatably fitted to pins extending from the base 58, as described above with reference to the first embodiment.

As is well known in the art, the free edges 62.1, 58.1 of the lid 62 and base 58, respectively, may be fitted with complementary snap-fit formations 62.2, 58.2, respectively, to enable the base 58 and the lid 62 to be securely fastened to each other when the lid 62 is in a closed position.

The casing 50 further comprises an intermediate floating tray 66 located between the base 58 and the lid 62, with the base 58 defining a recess 58.3 for snugly accommodating the intermediate tray 66 when the lid 62 is in the closed position. As described above, the intermediate tray 66 in turn may accommodate or house the cosmetic article 52 either loosely or within dedicated recesses 66.1, 66.2 for the cosmetic powder pan 54 and the applicator 56, respectively.

The intermediate tray 66 is slidably mounted to both the base 58 and lid 62 so as to be movable relative, to the base 58 and the lid 62, from a retracted position, as shown in FIGS. 8 and 9, in which the intermediate tray 66 substantially covers the base 58 and the mirror 60, to a semi-extended position, as shown in FIG. 10, and a fully extended position, in which the intermediate tray 66 exposes fully the base 58 and thus the mirror 60, as shown in FIGS. 7 and 11. The sliding action of the intermediate tray 66 relative to the base 58 occurs simultaneously with the sliding action of the intermediate tray 66 relative to the lid 62.

Thus, in use, but as will be explained in more detail further below, when the lid 62 is in the closed position the cosmetic article 52 can be visually inspected through the inspection window 64, and when the lid 62 is in the opened position the intermediate tray 66 is pulled away from the base 58 so as to expose the underlying mirror 60. In particular, the intermediate tray 66 is mounted to the base 58 and to the lid 62 so that when the lid 62 is moved from the closed position to the opened position, the intermediate tray 66 is pulled by the lid 62 and automatically slides, relative to both the base 58 and the lid 62, from the retracted position to the extended position so as to expose the mirror 60.

In an embodiment, the base 58 comprises a pair of opposed first guide channels 58.4, 58.5 and the intermediate tray 66 comprises a corresponding pair of first guide pins 66.3, 66.4 extending from the side walls of the tray 66. Similarly, the lid 62 comprises a pair of second guide channels 62.3, 62.4 and the intermediate tray 66 comprises a pair of second guide pins 66.5, 66.6 that can slide along the second guide channels 62.3, 62.4 of the lid 62 as the lid 62 is moved from the closed position to the opened position (and thus as the tray 66 moves from the retracted position to the extended position). The second guide channels 62.3, 62.4 are rectilinear and extends along a direction which is perpendicular to the axis of rotation of the lid 62 relative to the base 58. The guide pins 66.3, 66.4, 66.5, 66.6 are snugly accommodated within the guide channels 58.4, 58.5, 62.3, 62.4 and are constrained to travel securely along the length of these guide channels 58.4, 58.5, 62.3, 62.4.

The lengths of the first and second guide channels 58.4, 58.5, 62.3, 62.4 are designed so as to limit the length of travel of the tray 66 between its retracted and extended positions. Thus, when the first guide pins 66.3, 66.4 abut against the ends of the first guide channels 58.4, 58.5, the second guide pins 66.5, 66.6 abut against the ends of the second guide channels 62.3, 62.4, so as to define the fully opened position shown in FIGS. 7 and 11. In one version, the first guide channels 58.4, 58.5 extend substantially along the entire length of the base 58, with this distance corresponding substantially with the width of the underlying mirror 60, and the second guide channels 62.3, 62.4 extend up to approximately midway of the length of the lid 62.

The casing 50 includes a pair of support arms 68, 70 having a first end which is hinged to the base 58 and a second end which is hinged to the intermediate tray 66, so as to guide the sliding movement of the intermediate tray 66 relative to the base 58 and the lid 62.

As best shown in FIG. 7, the lid 62 is rotatably mounted to the base 58 about a first axis of rotation 72, the intermediate tray 66 is slidably mounted to the base 58 according to a second axis of sliding 74, and the intermediate tray 66 is slidably mounted to the lid 62 according to a third axis of sliding 76. The second and third axes 74, 76 are perpendicular to the first axis of rotation 72.

The present invention thus provides a cosmetic article casing having a window to allow a user to visually inspect the contents of the casing, but that allows the user, in a single gesture, to simultaneously provide access to the cosmetic article within the casing and to expose a mirror to facilitate application of the cosmetic product.

The invention claimed is:

1. A casing for a cosmetic article, the casing comprising:

a base having an inner surface, a front side, and a rear side;

a lid rotatably and directly mounted to the base at the rear side, the lid being rotatable, relative to the base, between a closed position and an opened position; and an intermediate tray located between the base and the lid for accommodating the cosmetic article and covering the whole base, the intermediate tray being slidably mounted to the base so as to be movable relative to the base between a retracted position, in which the intermediate tray covers the inner surface of the base, and an extended position, in which the intermediate tray exposes the inner surface of the base, the intermediate tray being further rotatably mounted to the lid so as to be movable relative to the lid, wherein rotation of the lid from the closed position to the open position causes the tray to slide from the retracted position to the extended position;

wherein the base comprises a base guide channel and the intermediate tray comprises a base guide pin that can slide translationally along and within the base guide channel of the base as the intermediate tray slides between the retracted and extended positions;

wherein rotation of the lid from the closed position to the open position causes the base guide pin to slide toward the rear side of the base.

2. The casing of claim 1, wherein the inner surface has a mirror, so that when the lid is in the opened position and the intermediate tray is in the extended position, the mirror is exposed.

3. The casing of claim 2, wherein the base defines a recess for snugly accommodating the intermediate tray when the lid is in the closed position, with the mirror accordingly being sandwiched between the base and the intermediate tray.

4. The casing of claim 1, wherein the lid comprises an inspection window, so that when the lid is in the closed position the cosmetic article can be visually inspected through the inspection window.

5. The casing of claim 2, wherein the intermediate tray is mounted to the lid so that when the lid is rotated from the closed position to the opened position, the intermediate tray automatically slides from the retracted position to the extended position so as to expose the mirror.

6. The casing of claim 1, wherein the base guide channel allows the simultaneous rotation and translation of the base guide pin within the base guide channel.

7. The casing of claim 1, wherein the lid is rotatably mounted to the base about a first axis, and the intermediate tray is slidably mounted to the base according to a second axis, the second axis being perpendicular to the first axis.

8. The casing of claim 1, wherein the intermediate tray is rotatably mounted to the lid, with the rotatable mounting between the lid and the base and the rotatable mounting between intermediate tray and the lid defining a hinging arrangement to cause the automatic sliding of the intermediate tray relative to the base when the lid is moved from the closed position to the opened position.

9. The casing of claim 1, wherein the intermediate tray is slidably mounted to the lid so as to be slidably movable, relative to the lid, when the lid is rotated from the closed position to the opened position.

10. The casing of claim 9, wherein the sliding movement of the intermediate tray relative to the base occurs simultaneously with the sliding movement of the intermediate tray relative to the lid.

11. The casing of claim 9, wherein the lid comprises a lid guide channel and the intermediate tray comprises a lid guide pin that can slide along the lid guide channel of the lid as the lid is rotated from the closed position to the opened position.

12. The casing of claim 11, wherein the intermediate tray is rotatably mounted to the lid, with the lid guide channel allowing the simultaneous rotation and translation of the lid guide pin within the lid guide channel.

13. The casing of claim 9, including a support arm having a first end which is hinged to the base and a second end which is hinged to the intermediate tray, so as to guide the sliding movement of the intermediate tray relative to the base and the lid.

14. The casing of claim 9, wherein the inner surface has a mirror, so that when the lid is in the opened position and the intermediate tray is in the extended position, the mirror is exposed.

15. The casing of claim 14, wherein the base defines a recess for snugly accommodating the intermediate tray when the lid is in the closed position, with the mirror accordingly being sandwiched between the base and the intermediate tray.

16. The casing of claim 9, wherein the lid comprises an inspection window, so that when the lid is in the closed position the cosmetic article can be visually inspected through the inspection window.

* * * * *